United States Patent [19]

Noguchi

[11] Patent Number: 4,507,912

[45] Date of Patent: Apr. 2, 1985

[54] PNEUMATIC YARN SPLICING APPARATUS

[75] Inventor: Kazuyoshi Noguchi, Kyoto, Japan

[73] Assignee: Murata Kikai Kabushiki Kaisha, Kyoto, Japan

[21] Appl. No.: 436,776

[22] Filed: Oct. 26, 1982

[30] Foreign Application Priority Data

Oct. 27, 1981 [JP] Japan ..... 56-171583
Oct. 27, 1981 [JP] Japan ..... 56-171584

[51] Int. Cl.[3] ..... B65H 69/06; D01H 15/00; D02J 1/08

[52] U.S. Cl. ..... 57/22; 57/261

[58] Field of Search ..... 57/22, 23, 202, 261–263

[56] References Cited

U.S. PATENT DOCUMENTS

| | | | |
|---|---|---|---|
| 4,240,247 | 12/1980 | Matsui et al. | 57/202 |
| 4,263,775 | 4/1981 | Mima | 57/22 |
| 4,361,003 | 11/1982 | Bertoli | 57/22 |
| 4,386,494 | 6/1983 | Felix | 57/22 |
| 4,411,128 | 10/1983 | Mima | 57/22 |

*Primary Examiner*—John Petrakes
*Attorney, Agent, or Firm*—Spensley Horn Jubas & Lubitz

[57] ABSTRACT

A pneumatic yarn splicing apparatus comprising a yarn end untwisting means and a fluid jetting means for splicing lapped yarn ends by intertwining the yarn ends by the swirling air stream. X-figured guide groove comprising yarn end introducing grooves and yarn end untwisting grooves is formed on the nozzle block and a fluid jet nozzle for splicing the yarn ends is disposed at the intersecting portion of the guide groove.

14 Claims, 11 Drawing Figures

PNEUMATIC YARN SPLICING APPARATUS

BACKGROUND OF THE INVENTION

In a pneumatic yarn splicing apparatus, yarn ends to be spliced are untwisted to separate fibers of the yarn ends, the yarn ends to be spliced are doubled in this fiber-separated state, compressed air is applied to the doubled portion and twisting or torsion is caused in the doubled portion by swirling air streams, and the fibers of both the yarn ends are entangled with one another to integrate both the yarn ends with each other, whereby the splicing operation is accomplished.

This process is illustrated in the specification of U.S. Pat. No. 4,240,247 and U.S. Pat. No. 4,263,775.

In the above-mentioned splicing process, a control nozzle for sucking the yarn ends and jetting a jet stream to the yarn ends to untwist the yarn ends and a splicing member for applying a jet stream to the yarn ends to twist them are independently arranged according to the conventional technique. Especially, since the control nozzle bends the end of yarn sucked in the splicing apparatus in a direction intersecting the yarn-sucking direction to untwist the yarn end and draws out the untwisted yarn end from the control nozzle again, there is often formed a portion in which opening or separation of fibers of the yarn end is insufficient.

Furthermore, since the splicing member supports only a limited part of the yarn end to be spliced but does not support entirely the yarn to be processed, it is considered that when the spliced portion is twisted by applying a jet stream thereto, slackening of fibers is caused between the supported part and the unsupported part.

Moreover, the foregoing untwisting and entangling operations are carried out in a groove in which the yarn ends are contained, and in order to uniformalize the lengths of the untwisted yarn ends, it is necessary that a cutter disposed outside the groove should be actuated to cut the yarn ends. Accordingly, the time required for the splicing operation is inevitably prolonged by the time for operating the cutter, and provision of the cutter is not preferred from the viewpoint of the operation efficiency. Still further, a cam mechanism and other members should be necessary if this cutter is disposed.

SUMMARY OF THE INVENTION

The present invention relates to a pneumatic splicing apparatus, and it is a primary object of the present invention to provide a pneumatic splicing apparatus in which untwisting and splicing of yarn ends performed substantially in the linear state in a series of yarn guiding grooves and untwisting and separation of fibers of yarn ends are performed sufficiently and completely to produce complete entanglement of fibers in the spliced portion.

In the apparatus of the present invention, untwisting, twisting and entanglement of yarn ends can be performed in a series of yarn guide grooves while the yarn is kept substantially linear. Furthermore, in a yarn end untwisting groove, a projection for narrowing the cross-section of this untwisting groove is disposed, and simultaneously with the untwisting of the yarn end, fibers of the yarn are caused to impinge against the projection formed on the inner wall of the groove by an air stream blown for untwisting the yarn end to cut the yarn end at this projection, whereby the time and device for the cutting operation are omitted.

DETAILED DESCRIPTION OF THE PREFERRED EMBODIMENTS

An embodiment in which a yarn end YB on the bobbin side and a yarn end YP on the package side are spliced by the splicing apparatus 100 of the present invention will now be described with reference to the accompanying drawings.

Figure 2:
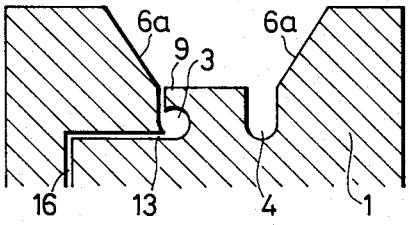
FIG. 2 is a view showing the section taken along the line II—II in FIG. 1.
Figure 3:
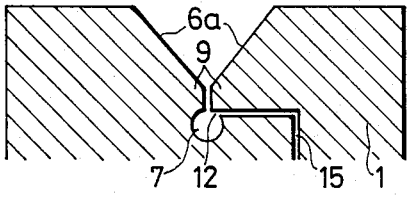
FIG. 3 is a view showing the section taken along the line III—III in FIG. 1.
Figure 4:
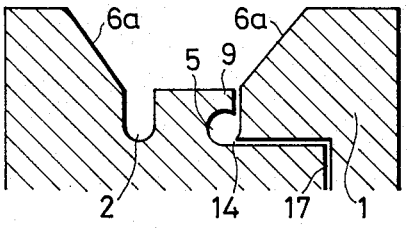
FIG. 4 is a view showing the section taken along the line IV—IV in FIG. 1.
Figure 5:
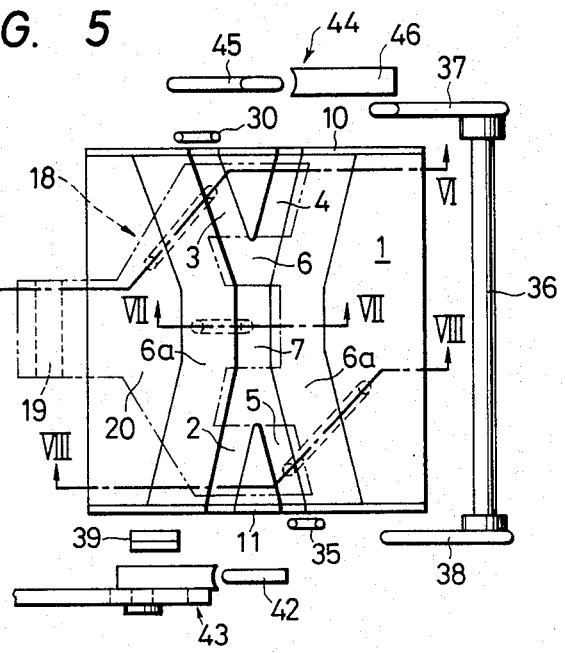
FIG. 5 is a front view illustrating another embodiment of the splicing apparatus of the present invention.
Figure 6:
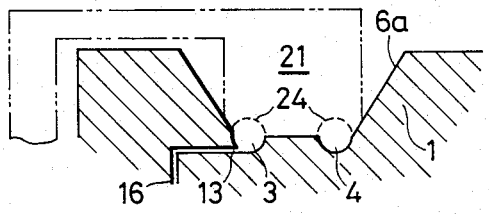
FIG. 6 is a view showing the section taken along the line VI—VI in FIG. 5.
Figure 7:
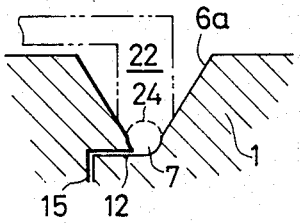
FIG. 7 is a view showing the section taken along the line VII—VII in FIG. 5.
Figure 8:
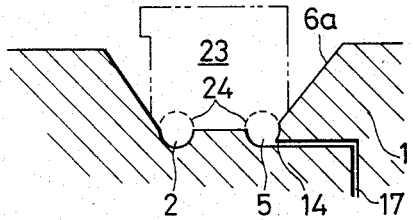
FIG. 8 is a view showing the section taken along the line VIII—VIII in FIG. 5.
Figure 9:
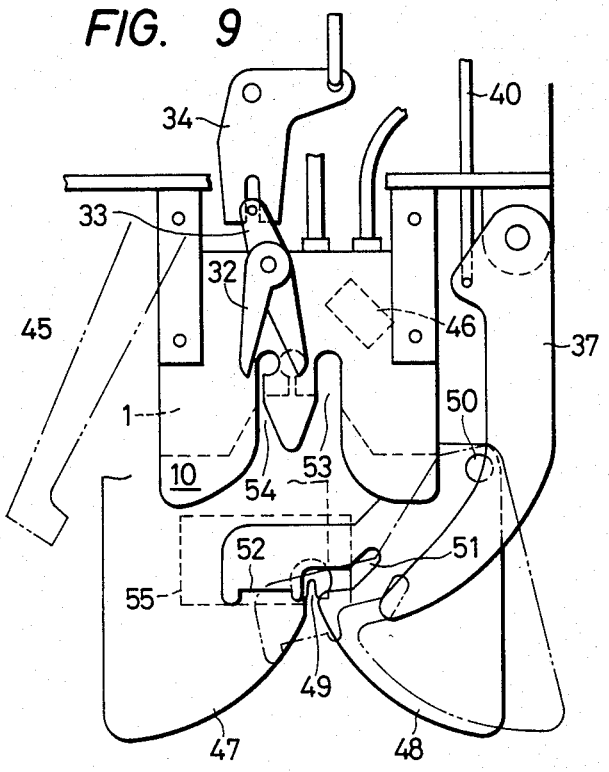
FIG. 9 is a plan view showing still another embodiment of the splicing apparatus of the present invention.
Figure 10:
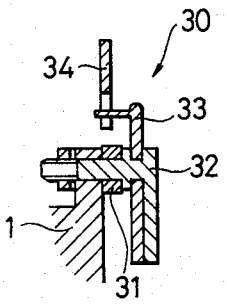
FIG. 10 is a sectional view showing a cutter.

An X-shaped yarn guide groove 6 having an arcuate bottom and comprising a first yarn end introducing groove, that is, a groove 2 for introducing the yarn end on the bobbin side, a first yarn end untwisting groove, that is, a groove 3 for untwisting the yarn end on the bobbin side, a second yarn end introducing groove, that is, a groove 4 for introducing the yarn end on the package side, and a second yarn end untwisting groove, that is, a groove 5 for untwisting the yarn end on the package side, is formed on the front face of a nozzle block . The X-shaped crossing portion of the respective grooves is used as a yarn intertwining zone 7. A cover 9 is formed on the untwisting grooves 3 and 5 and yarn intertwining zone 7 except a small slit 8 for the pass of the yarn, and in this portion, the yarn guide groove 6 have a substantially circular section. Guide plates 10 and 11 are formed on the end portions of the grooves 2, 3, 4 and 5, that is, end faces of the nozzle block 1. In the yarn intertwining zone 7, a fluid jet nozzle 12 is opened in the tangential direction of the yarn guide groove 6 so that the fluid jet nozzle 12 is located on an imaginary plane intersecting the yarn guide groove 6 in the yarn intertwining zone 7 at a right angle. In the present embodiment, the fluid jet nozzle 12 is opened so that the fluid jetted from the nozzle 12 is turned counteclockwise in the yarn guide groove 6, but the direction of jetting of the fluid in the yarn intertwining zone 7 is not particularly critical. Fluid jet nozzles 13 and 14 are formed on the groove 3 for untwisting the yarn end on the bobbin side and the groove 5 for untwisting the yarn on the package side, respectively. The fluid jet nozzle 13 is opened in the tangential direction of the groove 3 for untwisting the yarn end on the bobbin side so that the compressed fluid is jetted toward the open end of said groove 3. Similarly, the fluid jet nozzle 14 is opened in the tangential direction of the groove 5 for untwisting the yarn end on the package side so that the compressed fluid is jetted toward the open end of said groove 5. As shown in sectional views of FIGS. 2 and 4, the fluid jet nozzles 13 and 14 are opened in the tangential directions of the yarn end untwisting grooves 3 and 5 so that the jet stream is turned counterclockwise in the nozzle 13 and the jet stream is turned clockwise in the nozzle 14. The present embodiment is applied to the case where the yarn to be processed is a Z-twist yarn. If the yarn to be processed is an S-twist yarn, the fluid jet nozzles 13 and 14 should be opened in the directions opposite to the above-mentioned directions. Conduits 15, 16 and 17 for supplying the compressed fluid to the nozzles 12, 13 and 14 are connected to a pressure source (not shown).

Figure 1:
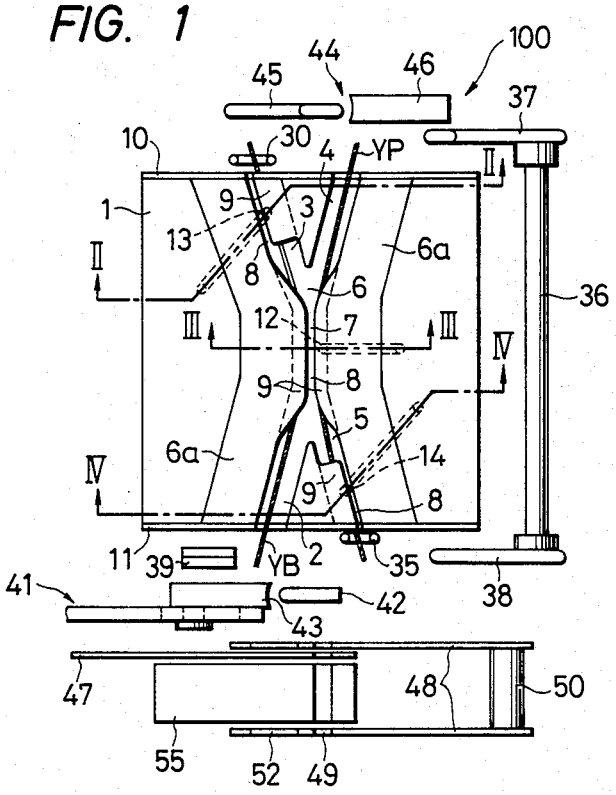
FIG. 1 is a front view showing one embodiment of the splicing apparatus of the present invention.

In the embodiment shown in FIG. 1, the cover 9 is formed on the yarn guide groove 6. Instead of this cover, a cover 18 as shown in FIGS. 5 through 8, may be disposed. The cover 18 is mounted on the top end of an arm-like member 20 supported on a supporting member (not shown) disposed outside the nozzle block 1 through a shaft 19 and comprises a covering member 21 covering the groove 3 for untwisting the yarn end on the bobbin side and the groove 4 for introducing the yarn end on the package side, a covering member 22 covering the yarn intertwining zone 7 and a covering member 23 covering the groove 2 for introducing the yarn end on the bobbin side and the groove 5 for untwisting yarn end on the package side. Concave portions 24 are formed on the lower faces of the covering members 21, 22 and 23 to construct cylindrical passage with the grooves 2, 3, 4 and 5 and the groove at the intertwining zone 7.

In the present embodiment, when the yarn is first introduced into the nozzle block 1, the arm-like member 20 is turned with the shaft 19 being as the center by a mechanism not shown in the drawings to open the yarn guide groove 6.

A cutter 30 is disposed outside the opening of the groove 3 for cutting the yarn end on the bobbin side. The cutter 30 comprises a stationary blade 32 secured to the nozzle block 1 and a movable blade 33 turnable fitted with the stationary blade 32. The movable blade 33 is engaged with a crank 34 swung by a cam mechanism (not shown). Reference numeral 31 represents a spacer, and the distance from the nozzle block 1 can appropriately be adjusted by selecting a certain spacer among spacers differing in the thickness. Another cutter 35 is disposed outside the opening of the groove 5 for cutting the yarn end on the package side. The structure of the cutter 35 is the same as that of the cutter 30.

A pair of yarn gathering levers 37 and 38 are arranged on the side portion of the nozzle block 1 in the state where the levers 37 and 38 are turnably secured to the upper and lower portions of a supporting shaft 36. Reference numeral 39 represents a stopper for the yarn gathering lever 37. A rod 40 is supported on the yarn gathering lever 37 so that when the rod 40 is drawn by a cam mechanism (not shown), the yarn gathering lever 37 is caused to make a swinging movement. A clamping device 41 for clamping the yarn end on the bobbin side comprises a turning lever 42 and a stopper 43, and a clamping device 44 for clamping the yarn end on the package side comprises a turning lever 45 and a stopper 46.

A stationary guide plate 47 and a turning guide plate 48 are disposed below the clamping device 41 for clamping the yarn end on the bobbin side. A guide groove 49 of the stationary guide plate 47 is made in agreement with an opening of an escape groove 51 of the turning guide plate 48, and when the turning guide plate 48 supported on a shaft 50 is turned, the stationary guide plate 47 anchors a yarn YP in the guide groove 49 on a hook portion 52 and pushes out the yarn YP from the groove 49 to guide it into the escape groove 51.

In the present embodiment, the apparatus of the present invention is used for splicing a yarn when the yarn is wound from a bobbin located in the lower portion of a winding machine or the like onto a package located in the upper portion thereof, and the package is set above the apparatus of the present invention and the bobbin is set below the apparatus of the present invention.

The operation of the apparatus of the present invention having the above-mentioned structure will now be described.

When a detecting device 55 detects breakage of a yarn being rewound or disappearance of a yarn layer on the bobbin, a package winding drum comes to stop and the splicing operation is started.

The yarn end YP on the package side is introduced into the splicing apparatus 100 in the state where the yarn end is sucked by a suction arm (not shown). The yarn end on the package side, which is sucked by the suction arm, is guided through the stationary guide plate 47 and the guide groove 49 of the turning guide plate 48, and after the yarn end YP is detected by the detecting device 55, the turning guide plate 48 is turned with the shaft 50 being as the center and the yarn YP is inserted in an escape groove 51. Then, a suction arm (not shown) on the bobbin side sucks the yarn end YB on the bobbin side to guide it into the splicing apparatus 100 and stop it there. At this time, the yarn end YB on the bobbin side is passed through the hook portion 52 of the turning guide plate 48 and is held by the turning lever 42 and stopper 43 of the clamping device 41 on the bobbin side. When the operations of the suction arms (not shown) on the bobbin side and the package side are completed, the yarn gathering levers 37 and 38 are turned, and the yarn ends YP and YB on the package side and bobbin side are guided into the guide grooves 53 and 54 of the guides 10 and 11 and inserted into the yarn guide groove 6 from an inclined face *6a* through the slit 8.

Then, the yarn ends sucked by the suction nozzle are cut by the cutters 30 and 35. The yarn cutting position has an influence upon the length of the joint formed by the splicing operation, and the appearance, touch and binding strength of the joint.

When the yarn ends YB and YP are pressed by appropriate means at the position close to the yarn intertwining portion in the yarn end untwisting grooves 3 and 5 after the insertion of the yarn ends YB and YP into the yarn guide groove 6, it is possible to prevent transference of shaking of yarn end on the untwisting operation. So, untwisting of the yarn ends can be performed more assuredly in a better condition.

Then, a compressed fluid is jetted from the fluid jet nozzles 13 and 14, and simultaneously with or just after the jetting of the compressed fluid, the yarn gathering lever 37 is turned in the direction separating from the yarn.

The yarn ends YB and YP receive the fluid jetted from the fluid jet nozzles 13 and 14, and in the yarn end untwisting grooves 3 and 5, the yarn ends are subject to swirling streams of the jetted fluid flowing in the direction untwisting the Z-twist, whereby the yarn ends are untwisted. The degree of the untwisting can appropriately be adjusted by controlling the pressure of the jetted fluid and the jetting time.

Then, the yarn gathering levers 37 and 38 are operated again to gather the yarn ends so that the yarn end on the package side and the yarn end on the bobbin side are lapped together. The compressed fluid is applied to the lapped yarn ends by the fluid jetting nozzle, and by the formed swirling streams of the jetted fluid, the untwisted yarn ends are entangled and integrated with each other and the integrated portion is twisted by turning the integrated portion. Furthermore, entanglement of fiber ends on both the sides of the integrated portion is simultaneously caused to effect splicing without formation of horns. Since the fluid is jetted from the fluid jet nozzles 13 and 14 during the splicing operation, streams running toward the openings of the yarn end untwisting grooves 3 and 5 are formed in the grooves 3 and 5, and the fibers of the untwisted yarn ends being intertwined in the yarn intertwining zone 7 are drawn in the state where they are carried on streams running outwardly of the yarn intertwining portion 7. Accordingly, when the fibers are connected to form one yarn, the fiber ends are naturally entangled with the yarn and projections such as horns are not formed at all.

When the above-mentioned splicing operation is completed, the yarn gathering levers 37 and 38 separate from the yarns YB and YP, and the connected yarns YB and YP are discharged from the yarn guide groove 6 through the slit 8 and the ordinary rewinding state is restored.

In the second embodiment, the slit used in the first embodiment is not formed, but the covering members 21, 22 and 23 are arranged. Accordingly, when the yarn is inserted in the yarn guide groove 6, the arm-like member 20 is turned by the cam mechanism (not shown) to raise the covering members 21, 22 and 23. Then, the fibers of the yarn ends are untwisted and separated, and simultaneously, the yarn ends are cut in a desirable length in the above-mentioned untwisting grooves. An embodiment in which projections narrowing the cross-sections of the untwisting grooves are formed in the untwisting grooves so as to perform the above-mentioned cutting operation without using a cutter will now be described.

Figure 11:
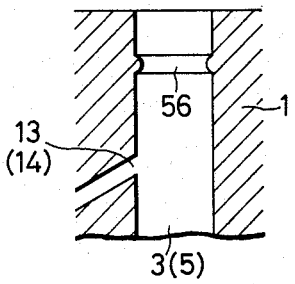
FIG. 11 is a sectional view showing another embodiment of the yarn end untwisting mechanism.

As shown in FIG. 11, projections 56 are formed on the walls of the yarn untwisting grooves 3 and 5 on the bobbin side and package side between the fluid jet nozzles 13 and 14 and the opening of the grooves 3 and 5. Each projection 56 has a function of narrowing the section of the groove at the position of the projection 56. The projections 56 have an annular continuous mountain-like shape as shown in FIG. 11, or a continuous mountain-like shape, a part of which is discontinuous. Alternatively, spot-like projections may be arranged in the annular form. When the yarn ends are turned and untwisted by the jet streams from the fluid jet nozzles, the fibers of the yarn ends impinge against the projections 56, whereby the fibers are cut at the positions of the projections 56. The positions of the projections 56 are appropriately determined according to the lengths of the yarn ends to be untwisted.

When the splicing operation is started in the above-mentioned manner and the operation of the suction arms on the bobbin side and the package side is completed, the yarn ends YP and YB on the package side and the bobbin side are introduced into the guide grooves 53 and 54 and inserted into the yarn guide groove 6 from the inclined face 6*a* through the slit 8.

Then, the compressed fluid is jetted from the fluid jet nozzles 13 and 14, and simultaneous with or just after the jetting of the compressed fluid, the yarn gathering lever 37 is turned in the direction separating from the yarn. At this time, the yarn ends YB and YP receive the jetted fluid from the fluid jet nozzles 13 and 14 and in the present embodiment, the yarn ends are untwisted by swirling streams of the jetted fluid running in the direction untwisting the Z-twist. The degree of the untwisting is appropriately adjusted by controlling the pressure of the fluid jetted from the fluid jet nozzles 13 and 14 and the jetting time.

The fibers of the yarn ends being turned and untwisted are caused to impinge against the projections 56 and the fibers are cut at the position of the projections 56 in the untwisting grooves. The cut fibers are blown away by the jet streams jetted from the fluid jet nozzles toward the openings of the untwisting grooves. The position for cutting the yarn ends is determined according to the length, appearance, touch and binding strength of the joint formed by the splicing operation.

As will be apparent from the foregoing description, in the apparatus of the present invention, the lapped yarn end portions are exposed to a compressed fluid to entangle the fibers of the yarn end portions with one another, and a portion of the zone for untwisting and entangling the yarn ends is formed to have a groove-like shape, the yarn ends are introduced into this groove and jet streams flowing in the groove toward the opening thereof are applied to the yarn ends. Accordingly, a drawing force is always imposed to the yarn ends and splicing and entanglement can therefore be accomplished in the state where the untwisted fibers are well arranged. By dint of this structural feature, uneven projection of fiber ends, resulting in formation of small lump-like horns, can be prevented.

Furthermore, since the splicing operation is carried out within the groove-like member, even if the yarn is turned by the jet stream, this turning is done in a series of grooves of the groove member and hence, the section of the yarn is prevented from becoming uneven.

Moreover, if projections are disposed in the grooves for untwisting the introduced yarn ends to be spliced, the fibers of the yarn ends are caused to impinge against the projections and the fibers are cut at the positions of the projections. Accordingly, cutting of the yarn ends is accomplished simultaneously with untwisting of the yarn ends, and the splicing time can be shortened effectively and any particular device need not be disposed for cutting the yarn.

What is claimed is:

1. An apparatus for splicing spun yarns including a nozzle block having opposed sides and means for applying a jet fluid stream to the overlapped, untwisted yarn ends which are introduced from the opposite sides of said block, characterized in that a generally X-shaped guide groove is formed in the nozzle block, the guide groove comprising a first yarn end introducing groove, a first yarn end untwisting groove having an untwisting zone, a second yarn end introducing groove, a second yarn end untwisting groove having an untwisting zone and a splicing groove having an intertwining zone for splicing the overlapped, untwisted yarn ends, the intertwining zone being positioned at the intersecting portion of the X-shaped guide groove, the untwisting and splicing grooves positioning and supporting the yarn ends to be spliced and being provided in a common plane.

2. An apparatus for splicing spun yarns as claimed in claim 1, wherein a cover having a slit for inserting yarns into the generally X-shaped guide groove is formed on the first and second untwisting grooves at the untwisting zones therein and on the splicing groove at the yarn intertwining zone so that said first and second untwisting and splicing grooves form a portion of a channel having a substantially circular cross section at said untwisting and intertwining zones.

3. An apparatus as claimed in claim 2, wherein the nozzle block includes a splicing fluid jet nozzle which is provided at the intertwining zone to be opened in a tangential direction with respect to the channel at said intertwining zone.

4. An apparatus as claimed in claim 2 or 3, wherein the nozzle block includes untwisting fluid jet nozzles which are provided at the untwisting zones to be opened in a tangential direction with respect to the channel at said untwisting zones of each groove and wherein the compressed fluid from the untwisting fluid jet nozzles is jetted toward the open end of said first or second yarn end untwisting groove respectively.

5. An apparatus as claimed in claim 4, wherein cutters for cutting yarn ends are disposed adjacent to the open ends of the first and second yarn end untwisting grooves.

6. An apparatus as claimed in claim 4, wherein projections are formed on the walls of each of the first and second yarn untwisting grooves, the projections being positioned between the fluid jet nozzles and the open end of said grooves and wherein the projections narrow the cross-sections of the grooves so that the fibers of the yarn ends impinge against the projections to be cut thereby.

7. An apparatus as claimed in claim 4, wherein said untwisting fluid jet nozzles provided at the untwisting zone are opened in the direction opposite to the direction of twists of the yarn ends to be untwisted.

8. An apparatus as claimed in claim 2, wherein said cover is formed integrally with the nozzle block.

9. An apparatus as claimed in claim 2, wherein said cover is mounted on the top end of an arm-like member supported on a supporting member by a shaft, the cover comprising a covering member for covering the first yarn end untwisting groove and the yarn end introducing groove being adjacent to the first yarn end untwisting groove, a covering member for covering the yarn intertwining zone of the splicing groove, and a covering member for covering the second yarn end untwisting groove and the other yarn end introducing groove being adjacent to the second yarn end untwisting groove.

10. An apparatus for splicing spun yarns comprising a nozzle block including:

means for untwisting yarn ends to be spliced, means for intertwining untwisted yarn ends, and first, second and third grooves for positioning and supporting yarns to be spliced in a common plane, the first and second grooves communicating with the third groove, the first groove having a zone where untwisting of the free end of a yarn to be spliced occurs, the second groove having a zone where untwisting of the free end of another yarn to be spliced occurs, the third groove having a zone where intertwining of untwisted free yarn ends occurs.

11. An apparatus for splicing spun yarns according to claim 10 further including cutting means for cutting the yarn ends to be spliced, the cutting means operating during the period of operation of the untwisting means.

12. An apparaus for splicing spun yarns comprising a nozzle block, the nozzle block having:

a first groove for positioning and supporting two overlapped, untwisted yarn ends, a first jet fluid nozzle for intertwining the two overlapped, untwisted yarn ends, the first jet fluid nozzle opening into the first groove, a second groove for positioning and supporting one of the yarn ends to be spliced, the second groove communicating with the first groove, a second jet fluid nozzle for untwisting the yarn end supported by the second groove, the second jet fluid nozzle opening into the second groove, a third groove for positioning and supporting the other of the two yarn ends to be spliced, the third groove communicating with the first groove, a third jet fluid nozzle for untwisting the yarn end supported by the third groove, the third jet fluid nozzle opening into the third groove, wherein the first, second and third grooves position and support the yarn ends in a common plane.

13. An apparatus for splicing spun yarns according to claim 12 wherein a projection for cutting the yarn ends to be spliced extends from the inner wall of each of the second and third grooves.

14. An apparatus for splicing spun yarns according to claim 12 further including means for cutting the yarn ends to be spliced, the cutting means being actuated by fluid flow from a jet fluid nozzle.

* * * * *